United States Patent [19]

Nakazima et al.

[11] 4,295,574

[45] Oct. 20, 1981

[54] BANDED-TYPE IMPLOSION PROTECTION CATHODE RAY TUBES

[75] Inventors: Kooichi Nakazima, Chosei; Keizo Kazama, Mobara; Hiroshi Oki, Chiba, all of Japan

[73] Assignee: Hitachi, Ltd., Tokyo, Japan

[21] Appl. No.: 149,380

[22] Filed: May 13, 1980

Related U.S. Application Data

[63] Continuation of Ser. No. 974,057, Dec. 28, 1978, abandoned.

[30] Foreign Application Priority Data

Feb. 20, 1978 [JP] Japan ..... 53-17664

[51] Int. Cl.[3] ..... H01J 31/00

[52] U.S. Cl. ..... 220/2.1 A; 358/245; 358/246

[58] Field of Search ..... 220/2.1 A, 2.2 A, 71, 220/73; 358/245, 246

[56] References Cited

U.S. PATENT DOCUMENTS

| | | | |
|---|---|---|---|
| 2,785,820 | 3/1957 | Vincent et al. | 220/2.1 A |
| 3,317,172 | 5/1967 | Balint | 358/246 X |
| 3,369,074 | 2/1968 | Massa | 358/245 |
| 3,576,395 | 4/1971 | Arrington et al. | 358/245 X |
| 3,597,537 | 8/1971 | Kudo et al. | 358/246 |
| 4,016,364 | 4/1977 | Rogers | 358/245 |
| 4,021,850 | 5/1977 | Rogers | 220/2.1 A X |
| 4,037,255 | 7/1977 | Hill | 220/2.1 A X |

FOREIGN PATENT DOCUMENTS

| | | |
|---|---|---|
| 45-3065 | 2/1970 | Japan . |
| 46-27618 | 8/1971 | Japan . |
| 47-13860 | 7/1972 | Japan . |

*Primary Examiner*—Steven M. Pollard
*Attorney, Agent, or Firm*—Charles E. Pfund

[57] ABSTRACT

In a cathode ray tube reinforced by an annular reinforcing band mounted on the face plate of the tube by shrink fit, the opposite ends of the band are coupled together by interfitting members which accurately determine the peripheral length of the reinforcing band.

2 Claims, 13 Drawing Figures

BANDED-TYPE IMPLOSION PROTECTION CATHODE RAY TUBES

This is a continuation of application Ser. No. 974,057 filed Dec. 28, 1978, now abandoned.

BACKGROUND OF THE INVENTION

This invention relates to a banded-type implosion protection cathode ray tube reinforced by a band which is applied by shrink fit.

To improve safety of a cathode ray tube against explosion, a reinforcing band is generally applied around the periphery of a face plate constituting a portion of the bulb of the cathode ray tube. Among various methods of applying the reinforcing band may be mentioned shrink fit method. According to this method, an annular reinforcing band 1 shown in FIG. 1 is heat expanded and then applied onto the periphery of the face plate 2*a* of the bulb 2. Then the reinforcingd band 1 is cooled to room temperature, thus causing it to tightly clamp the face plate with desired clamping force.

However, the periphery of the face plate 2*a* and the reinforcing band 1 have certain manufacturing error or tolerance so that, in order to smoothly fit the reinforcing band and cause it to manifest the desired clamping force with a small heat expansion thereof, it is necessary to manufacture the outer peripheral length of the face plate and the inner peripheral length of the reinforcing band with highly accurate manufacturing tolerances. Where the relationship between the inner and outer peripheral lengths is not adequate, insufficient clamping force or incapability of applying the reinforcing band would result. The prior art reinforcing band has been manufactured by welding together opposing ends of a metal strip so that the inner peripheral length of a completed annular reinforcing band was not always accurate.

Further, in the prior art banded-type implosion protection cathode ray tube as shown in FIGS. 2A and 2B, a plurality of mounting lugs 3 are provided between the outer periphery of the face plate 2*a* and the reinforcing band 1. Due to the thickness of the mounting lugs 3, gaps 4 are formed between the face plate and the reinforcing band, thus decreasing the clamping force. Accordingly, in the prior art construction, shims are inserted into the gaps for the purpose of preventing the decrease in the clamping force. However, insertion of thin shims is not only troublesome but also displaces the mounting lugs 3.

SUMMARY OF THE INVENTION

Accordingly, it is an object of this invention to provide an improved banded-type implosion protection cathode ray tube provided with a shrink fit reinforcing band having an accurate peripheral length so that it can be accurately mounted and can produce sufficient clamping force.

Another object of this invention is to provide a cathode ray tube having a novel reinforcing band that can improve the mounting accuracy of the mounting lugs and the mounting operation thereof.

According to this invention, there is provided a banded-type implosion protection cathode ray tube of the type wherein an annular reinforcing band having at least one joint is mounted on the periphery of the face plate of the cathode ray tube by shrink fit, wherein there is provided interfitting means formed at the joint of the band and adapted to determine the peripheral length of the reinforcing band.

DESCRIPTION OF THE PREFERRED EMBODIMENTS

Figure 1:
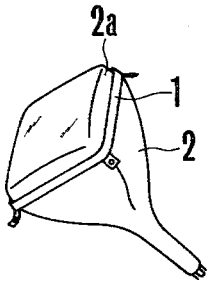
FIG.1 (PRIOR ART)
FIG. 1 is a perspective view showing a prior art banded-type implosion protection cathode ray tube.
Figure 2A:
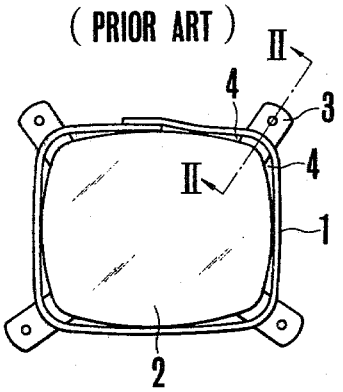
FIG.2A (PRIOR ART)
FIG. 2A is a front view of the cathode ray tube shown in FIG. 1.
Figure 2B:
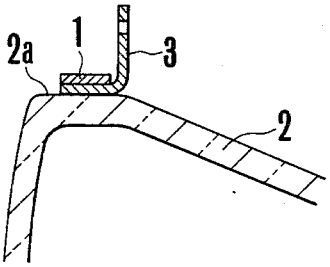
FIG.2B (PRIOR ART)
FIG. 2B is an enlarged sectional view taken along a line II—II shown in FIG. 2A.
Figure 3:
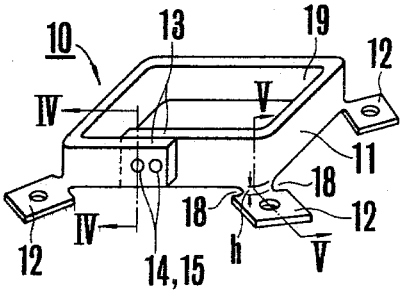
FIG. 3 is a perspective view showing one example of a reinforcing band utilized in the banded-type implosion protection cathode ray tube of this invention.
Figure 4:
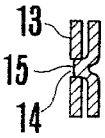
FIG. 4 is a sectional view taken along line IV—IV shown in FIG. 3.
Figure 5:
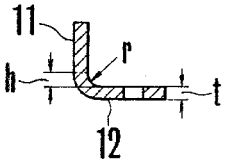
FIG. 5 is a sectional view taken along a line V—V in FIG. 3.

A reinforcing band 10 shown in FIGS. 3 and 4 comprises an annular or rectangular portion 11 and four mounting lugs 12 extending outwardly from the rectangular portion 11 at four corners of the face plate 8 see (FIG. 1). Preferably, the mounting lugs 12 are integral with the portion 11. One end of the reinforcing band is provided with openings 14 and the other end is provided with projections 15 fitted in the openings 14, both the ends overlapping with each other to form one paired joint 13. As shown in FIG. 5, it is necessary to bend a mounting lug 12 away from the side surface of the annular portion with a radius of curvature r layer than the thickness t of the band. If this radius of curvature were too small, the mounting lug might break or it would be impossible to maintain the desired accuracy. If the width of the bent portion of the mounting lug were too large, the edges of the bent portion would be excessively elongated at the time of bending so as to form cracks, thus decreasing the mechanical strength. According to this invention, for the purpose of solving this problem, the width of the bent portion of the mounting lug is decreased and the lug is bent at a portion remote from the side of the reinforcing band 11 by a distance corresponding to a height h which is 1.5 mm along with other dimensions as exemplified later in relation to a 5.5-inch cathode ray tube.

Although the reinforcing band can be formed into an annular configuration having a desired peripheral length by forming only one opening 14 for receiving one projection 15, according to this invention, two openings 14 and two projections 15 are formed so as to prevent overlapped portions of the joint from pivoting about one of the projections with consequent displacement in the lateral direction. Accordingly, one of the openings 14 may be elongated or may have a play in the longitudinal direction of the reinforcing band.

Figure 6:
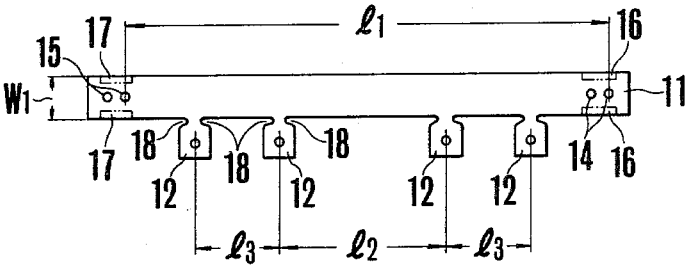
FIG. 6 is a plan view of a reinforcing band after stamping.
Figure 7A:
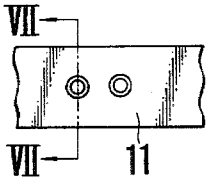
FIG. 7A is a side view showing a modified interfitting members.
Figure 7B:
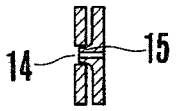
FIG. 7B is a sectional view taken along a line VII—VII in FIG. 7A.
Figure 8A:
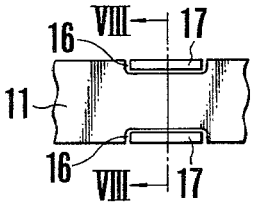
FIG. 8A is a side views showing a still further modification of the interfitting members.
Figure 8B:
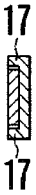
FIG. 8B is a sectional view taken along a line VIII—VIII shown in FIG. 8A.

The reinforcing band is manufactured as follows. Thus, as shown in FIG. 6, a reinforcing band is stamped out from a steel sheet with openings 14, projections 15 and mounting lugs 12 at the desired positions and with desired dimensions. Then the mounting lugs are bent at right angles with respect to the band and the band is sequentially bent into rectangular form by utilizing the mounting lugs as reference points. Then the projections are inserted into openings 14 and the opposite ends of the band are welded together at the joint 13.

Since the peripheral length of the completed reinforcing band can be determined from the positions of the stamped openings and projections, it is possible to have accurate peripheral length thus making it easy to mount the reinforcing band and to create sufficient clamping force. Moreover, as the mounting lugs are formed integral with the reinforcing band, the positional accuracy of the lugs can be improved.

One example of the dimensions of a reinforcing band for use in the 5.5-inch cathode ray tube is as follows.

$l_1=393$ mm, $l_2=110.5$ mm, $l_3=86.12$ mm

W=11 mm (see FIG. 6); diameter of the opening 14=3 mm, and diameter of the projection 15=2 mm.

FIGS. 7A, 7B, 8A and 8B show modified interfitting members. In the case shown in FIGS. 7A and 7B, the projections 15 take the form of rings while in the case shown in FIGS. 8A and 8B, one connecting portion is provided with notches 16 while the other connecting portion is formed with bent up portions 17 received in the notches 16. These notches and bent up portions are formed at portions shown by dotted lines in FIG. 6. In each case, these interfitting members can be formed with high accuracies by stamping.

Figure 9:
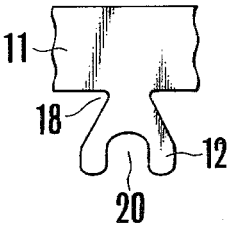
FIG. 9 is a side view showing a modified neck and opening of a mounting lug.

According to this invention, the width of the neck 18 which connects the mounting lug 12 to the band 11 is decreased so that even when the lug is bent at this neck, there is no fear of forming cracks on both sides of the bent portion. Moreover, it is possible to smoothly bend the corner portions 19 of the reinforcing band along the outside surface of the tube. With this construction it is possible to more uniformly clamp the tube by the reinforcing band. As shown in FIG. 9, the side edges of the neck 18 may be inclined and the opening 20 of the lug 12 may be a notch instead of a circular opening.

Figure 10:
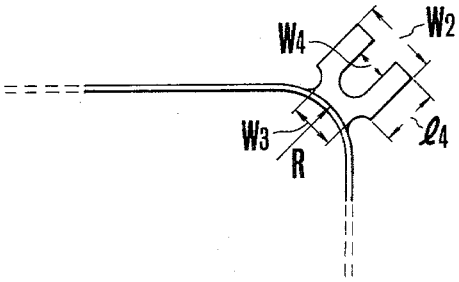
FIG. 10 is a plan view showing relative dimensions of a corner portion of the reinforcing band and a mounting lug.

One example of the dimensions of a reinforcing band for use in the 5.5-inch cathode ray tube is shown in FIG. 10. The reinforcing band was prepared from a steel sheet having a thickness of 0.8 mm and the inner peripheral length after welding was 390.7 mm. Various dimensions are: R=12.46 mm, $W_2=12$ mm, $W_3=8$ mm, $W_4=6$ mm, $l_4=9.9$ mm.

In the embodiment described above, the reinforcing band has only one (paired) joint 13. However, it is also possible to manufacture the band from two U-shaped pieces which are joined at two portions.

According to this invention it is possible to accurately manufacture the reinforcing band, to readily mount it around the face plate and to create uniform clamping force.

What is claimed is:

1. A combination of a cathode ray tube and an implosion protection tension band mounted on the periphery of the face plate of the cathode ray tube, said band comprising an annular reinforcing band which is so shaped, in advance of mounting of the same, as to be fitted to the periphery of the face plate, said annular reinforcing band being formed from an integral stamped flat metal strip, one end of which overlaps the other end substantially parallel to the adjacent periphery of said face plate and having lugs projecting from the edge of said strip; and interfitting means formed at the overlapped ends of said strip, said one end having an integral raised portion and said other end having an integral recess mating with said raised portion and adapted to be engaged for coupling together the opposite ends of said strip in fixed peripheral relation determined by said raised portion and said recess for accurately determining the inner peripheral length of said annular band, and a joint securing said overlapped ends to form said annular band with accurate said inner peripheral length which is sized to be under tension when thermally shrunk fit on said periphery of said face plate.

2. The combination of claim 1 wherein said lugs are connected to said strip by a narrowed section such that lugs can be bent at right angles to said strip without fracture and said strip can be formed as said annular band uniformly conforming throughout its length to the contour of the periphery of said face plate with said lugs accurately positioned for mounting said tube.

* * * * *